US006370847B1

(12) United States Patent
Jensen et al.

(10) Patent No.: US 6,370,847 B1
(45) Date of Patent: Apr. 16, 2002

(54) SEALABLE DIAPER-DISPOSAL SYSTEM AND METHOD

(76) Inventors: Tim Allan Nygaard Jensen; Victoria Marie Worden Jensen, both of 2525 Millington Dr., Plano, TX (US) 75093

( * ) Notice: Subject to any disclaimer, the term of this patent is extended or adjusted under 35 U.S.C. 154(b) by 0 days.

(21) Appl. No.: 09/963,700

(22) Filed: Sep. 26, 2001

Related U.S. Application Data

(60) Provisional application No. 60/237,483, filed on Oct. 2, 2000.

(51) Int. Cl.[7] ..... B65B 43/28; B65B 9/04; B65B 9/12

(52) U.S. Cl. ..... 53/459; 53/370; 53/576

(58) Field of Search ..... 53/370, 459, 477, 53/551, 567, 576

(56) References Cited

U.S. PATENT DOCUMENTS 3,908,336 A * 9/1975 Forslund ..... 53/183
4,550,553 A * 11/1985 Gaither ..... 53/202
4,790,124 A * 12/1988 Kaji ..... 53/552
4,869,049 A * 9/1989 Richards et al. ..... 53/459
5,155,976 A * 10/1992 Okabe et al. ..... 53/527
5,655,680 A * 8/1997 Asbach et al. ..... 220/404
5,813,200 A * 9/1998 Jacoby et al. ..... 53/567

* cited by examiner

*Primary Examiner*—Rinaldi I. Rada
*Assistant Examiner*—Hemant M. Desai
(74) *Attorney, Agent, or Firm*—Robert H. Johnston, III

(57) ABSTRACT

A diaper disposal system for packaging odorous waste objects in individual sealed (substantially air-tight) packages includes a body, base, hinged lid, flexible material, and a first sealing member and second sealing member. The sealing members are operable to seal or form a substantially air-tight seal in the flexible material to prevent the odor from escaping. The sealing members move between an open position and closed/sealing position by twisting an inner lid, closing the lid, or moving an activation arm. The sealing members preferably seal the tubing by thermally fusing the tubing. A method is also provided.

9 Claims, 6 Drawing Sheets

SEALABLE DIAPER-DISPOSAL SYSTEM AND METHOD

RELATED PATENT APPLICATION

This application claims priority of U.S. Provisional Application No. 60/237,483, filed Oct. 2, 2000, entitled, "Sealable waste-disposal system and method."

TECHNICAL FIELD OF THE INVENTION

The present invention relates to waste disposal, and more particularly, to systems and methods for sealing objects in packages formed from a flexible material. The invention is particularly well suited for disposing of odorous objects such as soiled diapers.

BACKGROUND OF THE INVENTION

On occasions, one would like to dispose of odorous objects in a convenient manner. This is particularly true of soiled, disposable diapers. If the diapers are collected in a disposal container as a batch, the odor can become quite strong and offensive. Efforts have been made to contain the odor of these soiled diapers. For example, U.S. Pat. No. 5,147,055, entitled "Diaper Container" shows a diaper container that includes an activated charcoal filter to retain and absorb odors within the container. U.S. Pat. No. 4,427,110, entitled, "Apparatus and Method for Handling used Disposable Diapers," shows a canister that has a seal insert that 10 uses radially disposed slits in it to allow the diaper to pass through it. Others have developed sophisticated valve systems to attempt to contain the odor. See, e.g., U.S. Pat. Nos. 5,651,231; 5,765,339; and 5,655,680.

Another popular approach to disposing of such diapers has been with a device for twisting flexible tubing upon itself to form a pouch about the diaper. See generally, U.S. Pat. No. 5,590,512, entitled, "Apparatus for Using Packs of Flexible Tubing in Packaging"; U.S. Pat. No. 5,813,200, entitled, "Packaging and Disposal System"; and U.S. Pat. No. 4,869,049 entitled, "Apparatus and Methods for Using Packs of Flexible Tubing in Packaging,"; all three of these patents are incorporated herein by reference for all purposes. An illustrative embodiment of such a device is shown in FIG. 1.

Referring to FIG. 1, a system 10 for disposing of soiled diapers in twisted packages 12 is shown. System 10 has a container body 14 with a hinged base 16, a hinged lid 18, and an upward cylinder 20 secured within the container body 14. A tubular core 22 rests on a portion of the upward cylinder 20 to allow rotation therebetween. A flexible tube or sleeve 24 rests on a portion of the tubular core 22 with the tubing being circumferentially pleated as stored. Springs 26 are fixed to the container 14 and project radially inward to engage a package 12. The springs are equally spaced around the interior of the container 14 to hold the package 12 during the forming of a twist such as twist 28.

To begin using system 10 to form a series of packages 12 of objects, the top of the flexible tubing 24 is pulled upwards and tied into a knot 30. The closed end formed by knot 30 can then form the bottom of a package 12 with the sidewalls formed by the tubing. The object is inserted and rests against the tubing near knot 30. Rotatable, interior lid 32 is put into place and rotated such that the unused tubing 24 and the tubular core 22 rotate with respect to the package 12 that is being formed. The package being formed does not rotate because it is held in place by friction between it and springs 26. Thus a package is formed between the knot and a first twist. Subsequently, objects are disposed and twisted in a like manner to form discrete packages with twists between them.

Systems like system 10 have been found to be a fairly convenient way of disposing of diapers and it has been found that such systems go a long way toward controlling odor. These systems, however, have shortcomings. First, the twists between packages sometimes come unraveled, allowing groups of diapers to collect within the tubing, which makes emptying the container more difficult. Further, the twists do not create a continuous, complete seal, and therefore, they allow some odors to escape. Increasing the twists between packages can help, but does not eliminate the odor and uses additional tubing. The odor that does escape may cause the entire container to smell over time.

The previous design does, however, present a fairly simple and economical design. In other areas, complicated systems have been used with sheaths to form discrete packages. Such systems use complicated, mechanical gripping clasps and sealing devices. An example of such a system is shown in European Patent 0 005 660 A1 filed May 7, 1979 and entitled "Device for Packaging of Objects in a Continuous Tubular Sheath and Having a Positive Drive Mechanism for the Sheath." Elements 17 and 19 move on rollers as part of a complex jaw arrangement. The relatively complex nature of this design and those like it tends to make it relatively expensive to manufacture.

SUMMARY OF THE INVENTION

Therefore, a need has arisen for a sealable waste disposal system and method that address shortcomings of previous systems and methods. According to an aspect of the present invention, a waste disposal system for placing objects in sealed packages, which are formed from a plastic material, has a container body, base, a hinged lid, an inner lid, a tubular core holding flexible tubing, and a sealing means that seals a portion of the flexible material together in a substantially air-tight manner while preferably cutting the flexible material to allow for discrete sealed packages to be formed with the objects therein, and wherein the sealing means includes two sealing members that are operable to travel between an open position to a closed (or sealing) position while the sealing members remain within a horizontal section or plane having a thickness no greater than ⅓ the lengthwise dimension, H, of the average package.

According to another aspect of the present invention, a system for disposing of odorous waste objects includes a container body, base, hinged lid, flexible material (.e.g., flexible tubing), and a first and second sealing member that are operable to form a substantially air tight seal in the flexible material and wherein the sealing members move between an open position and closed/sealing position by twisting an inner lid, closing the lid, or moving an activation arm.

According to another aspect of the present invention, a method for disposing of odorous waste objects is provided that includes the steps of placing the odorous objects in a container having a container body, base, a hinged lid, an inner lid, and a tubular core holding a flexible tubing with the flexible tubing forming a bottom portion for a package; sealing a portion of the flexible material together in substantially an air-tight manner; cutting the flexible tubing to allow for an individual sealed package to be formed with odorous objects therein; and wherein the step of sealing includes bringing two sealing members into substantial contact with each other to allow sealing and cutting to take place between them. The sealing members travel between an open position to a closed or sealing position while remaining within a horizontal plane having a thickness no greater than ⅓ of the lengthwise dimension of the average package. According to another aspect of the present invention, the sealing members travel between an open and closed position by twisting the inner lid, moving an attachment arm, or closing the hinged lid.

According to another aspect of the present invention, a method for disposing odorous objects is provided that includes placing the object in a bag and using a sealing means to seal the bag closed in an air-tight manner to form a package.

The present invention provides advantages; a number of examples follow. An advantage of the present invention is that a complete and continuous seal is produced thereby eliminating leakage of odors from formed packages. Another advantage is that a non-twisted seal also facilitates transfer of the packages for disposal. According to another advantage of the present invention, discrete packages are formed with seals that use a minimum amount of flexible material. Another advantage of the present invention is that it has a relatively simple mechanical design that allows relatively inexpensive manufacture.

BRIEF DESCRIPTION OF THE DRAWINGS

For a more complete understanding of the present invention and advantages thereof, reference is now made to the following description taken in conjunction with the accompanying drawings in which like reference numbers indicate like features, and wherein.

DETAILED DESCRIPTION OF THE INVENTION

The preferred embodiment of the present invention and its advantages are best understood by referring to FIGS. 2–7 of the drawings, like numerals being used for like and corresponding parts of the various drawings.

Figure 1:
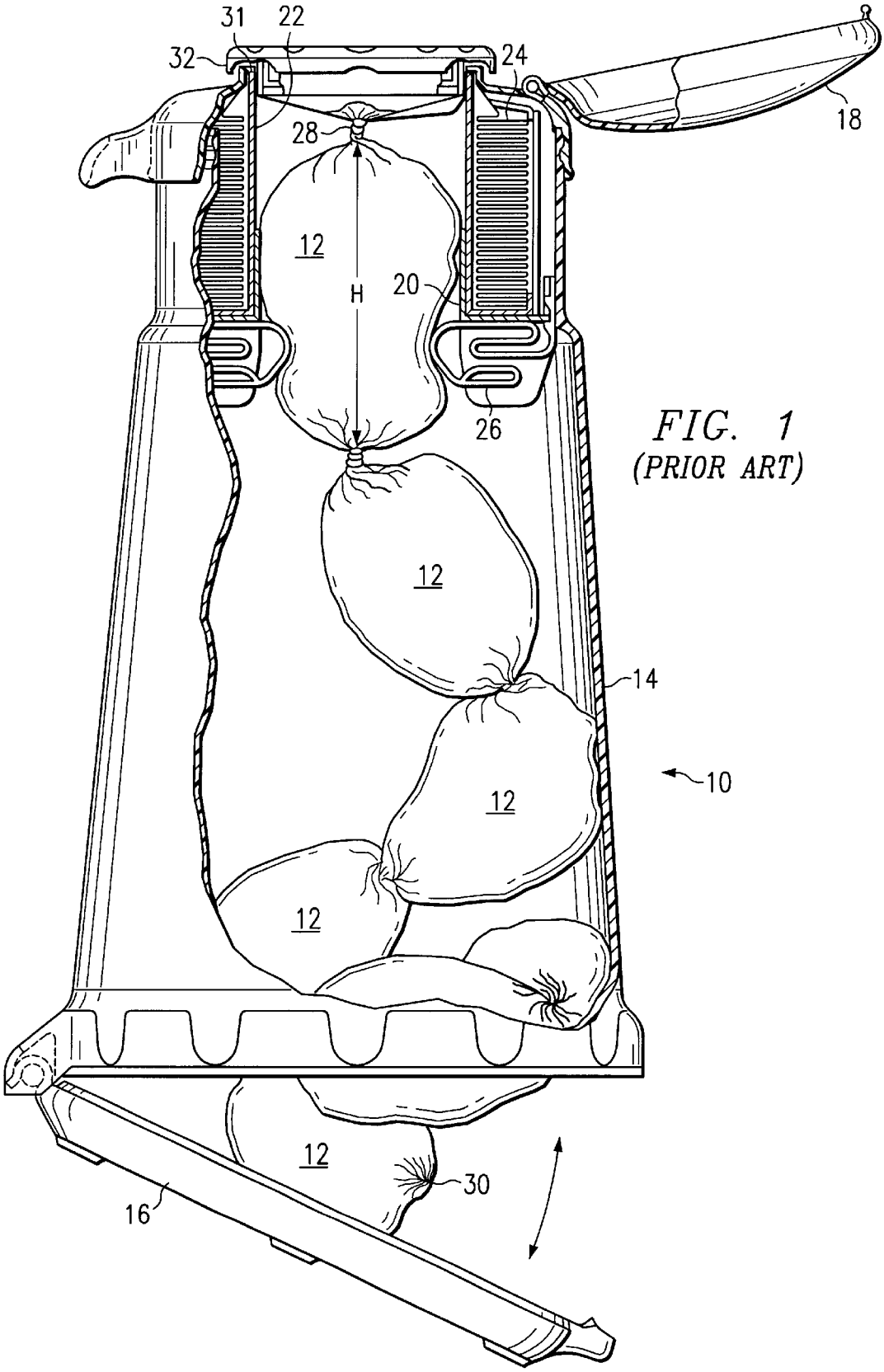
FIG. 1 (PRIOR ART)
FIG. 1 is an elevation view with portions broken away of a prior art device for forming a series of packages with twists between them.

The present invention in its most prominent embodiments is an improvement to the waste disposal devices and systems of the general type shown in FIG. 1. The following description in connection with FIGS. 2–7 shows features of the improved systems and methods and it is to be understood that all the remaining aspects of the design of the type in FIG. 1 may be incorporated as known in the art. The improvements of the present invention may be used as a retrofit or as a modification in manufacturing design.

Figure 2A:
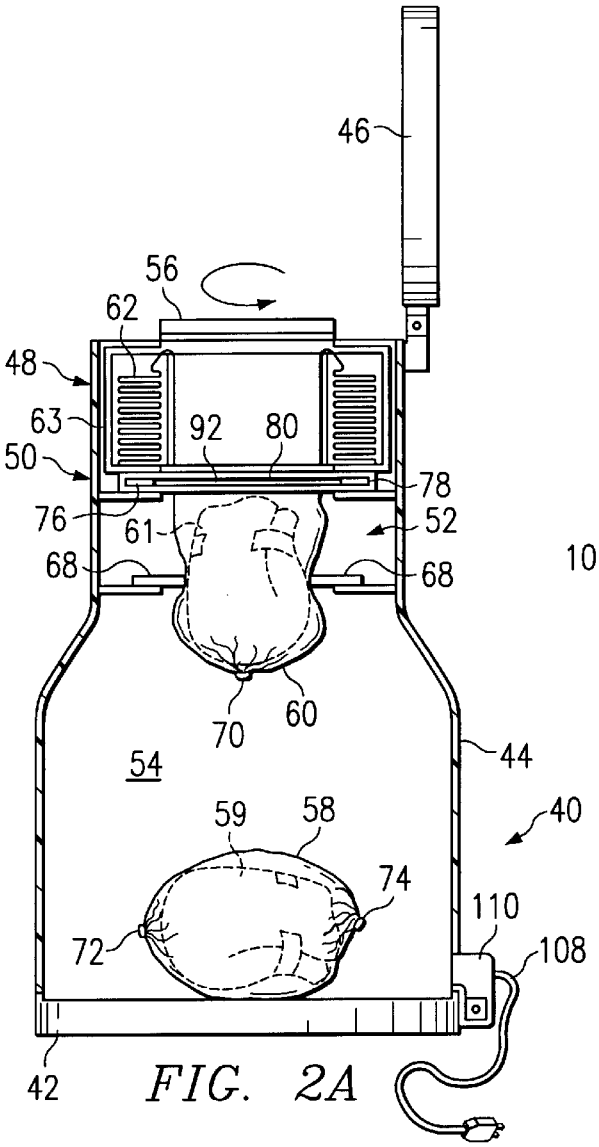
FIG. 2A is a schematic side view of a sealable waste disposal system in which the sealing action is carried out by twisting an inner lid.
Figure 2B:
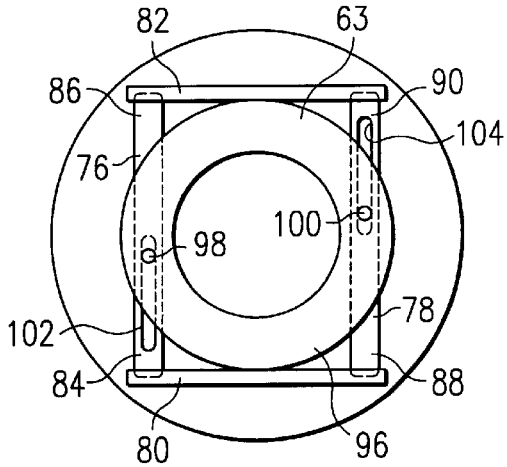
FIG. 2B is a top view of the system of FIG. 2A with the sealing members shown in the open position.
Figure 3:
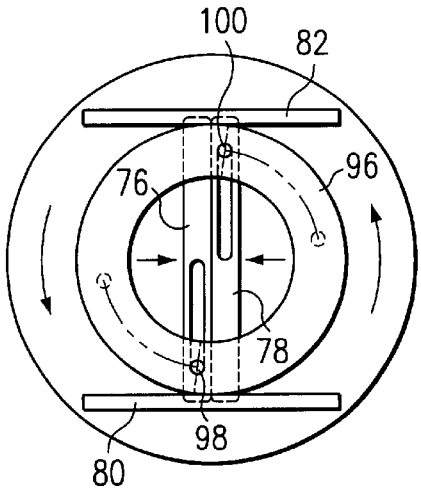
FIG. 3 is a top schematic view of the system of FIG. 2A shown with sealing members in the closed or sealing position.

Referring to FIGS. 2A, 2B and 3, a first embodiment of a sealable waste disposal system 40 is presented. System 40 includes a hinged base 42 and a container body 44. A hinged lid 46 is pivotably attached on a top portion. A number of discrete, general zones or areas (elevational planes having a thickness) are formed within system 40. The first area is a loading area 48 that extends from the upper portion of the container to approximately the sealing members 76 and 78. The second is a sealing area 50 that extends a small range around the sealing members 76 and 78. The third is a fill area 52 that extends from approximately the lower portion of the sealing members 76 and 78 to the springs 68. And finally, there is a storage area 54 that extends from the springs 68 to the top of the base 42. A rotatable inner lid 56 allows access to the loading area 48, and when in place, lid 56 may be rotated to cause the sealing and cutting of discrete packages such as package 58. Package 60 is shown being formed.

Flexible tubing 62 is stored within a portion of a tubular core 63. The flexible tubing may be any plastic tubing known in the art. As shown below in connection with FIG. 5B, a flexible bag might also be used. The flexible tubing runs over the top portion of core 63 and down through the loading area 48, through the sealing area 50 and down into the fill area 52. When an object such as object 61 (shown in broken lines) is placed within container 44, it will rest in the fill area 52 with the flexible tubing 62 around it and being held in the fill area by clasps or springs 68 (see also springs 26 in FIG. 1). As shown in FIG. 2A, the lower end of package 60 has already been sealed with a seal 70. Package 58 is shown with seals 72 and 74 forming a completed package. As an important aspect of the present invention, in sealing area 50, the flexible tubing 62 is sealed in a closed manner forming a substantially air-tight seal in two locations and is cut between these two locations as will be described further below. "Substantially air-tight seal" means that a seal is formed such that with an odorous substance within the package that is sealed with a substantially air-tight seal, the odor is not readily perceivable on the outside of the package by a human with normal sensing abilities.

Within sealing area 50 are a first sealing member 76 and a second sealing member 78. As shown in FIGS. 2B and 3, sealing members 76, 78 are slideably coupled (i.e., attached to them, but able to slide relative to them) to first and second stationary tracks 80, 82. The first sealing member 76 has a first end 84 and a second end 86 and second sealing member 78 has a first end 88 and a second end 90. Each of the stationary tracks 80, 82 has longitudinal openings in them such as longitudinal opening 92 (FIG. 2) in track 80. The first ends 84, 88 of tracks 76, 78 are disposed within longitudinal opening 92 of stationary track 80. Similarly, the second ends 86, 90 of sealing members 76, 78 are disposed within longitudinal opening of track 82. In this way, sealing members 76, 78 may slide within the stationary tracks 80, 82.

The tubular core 63, upon which the reserve portion of the flexible tubing 62 rests, is rotatable in conjunction with rotation of inner lid 56. The bottom portion of the tubular core 96 has a first pin 98 and a second pin 100. Pins 98, 100 are attached to the bottom of the tubular core 96. Pin 98 is sized and configured to extend through a longitudinal slot 102 formed on first sealing member 76 between first end 84 and a middle portion preferably. Similarly, second pin 100 is sized and configured to extend through a longitudinal slot 104 formed in second sealing member 78 between its second end 90 and a middle portion. Thus, when inner lid 56 is rotated, it causes the tubular core 63 to rotate with its pins 98, 100. The efforts to rotate pins 98, 100 causes them to move within longitudinal slots 102, 104, respectively, and as rotation occurs, brings sealing members 76, 78 towards each other when rotated in one direction and away from each other when rotated in the other direction. For the top views shown in FIGS. 2B and 3, rotation in a counterclockwise direction brings the sealing members 76, 78 together. FIG. 3 shows the sealing members together in a closed or sealing position. FIG. 2B shows the sealing members in an open position.

When in the closed position, the sealing members form two seals in the flexible tubing 62 and preferably cut the flexible tubing 62 between the two seals as will be described in more detail further below in connection with FIG. 7. The sealing is preferably performed through thermal sealing of the plastic material of the flexible tubing 62 but may also be performed by ultrasonic techniques, adhesives, or other sealing techniques. The preferable sealing technique is to use thermal energy provided through an electrical connection such as electrical cord 108 going to an electrical transformer 110. Electrical transformer 110 is connected by electrical wires (not shown) to one or both of the sealing members 76, 78 as will be described further below. The electrical source may alternatively be batteries.

Figure 4A:
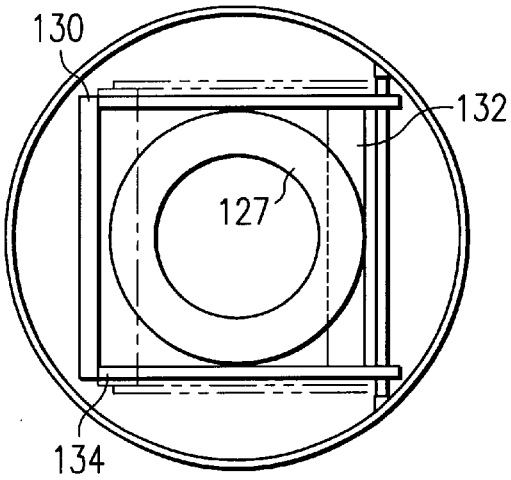
FIGS. 4A and 4B are a top and side schematic cross-sectional view respectively of another embodiment of a system for sealably disposing of waste.
Figure 4B:
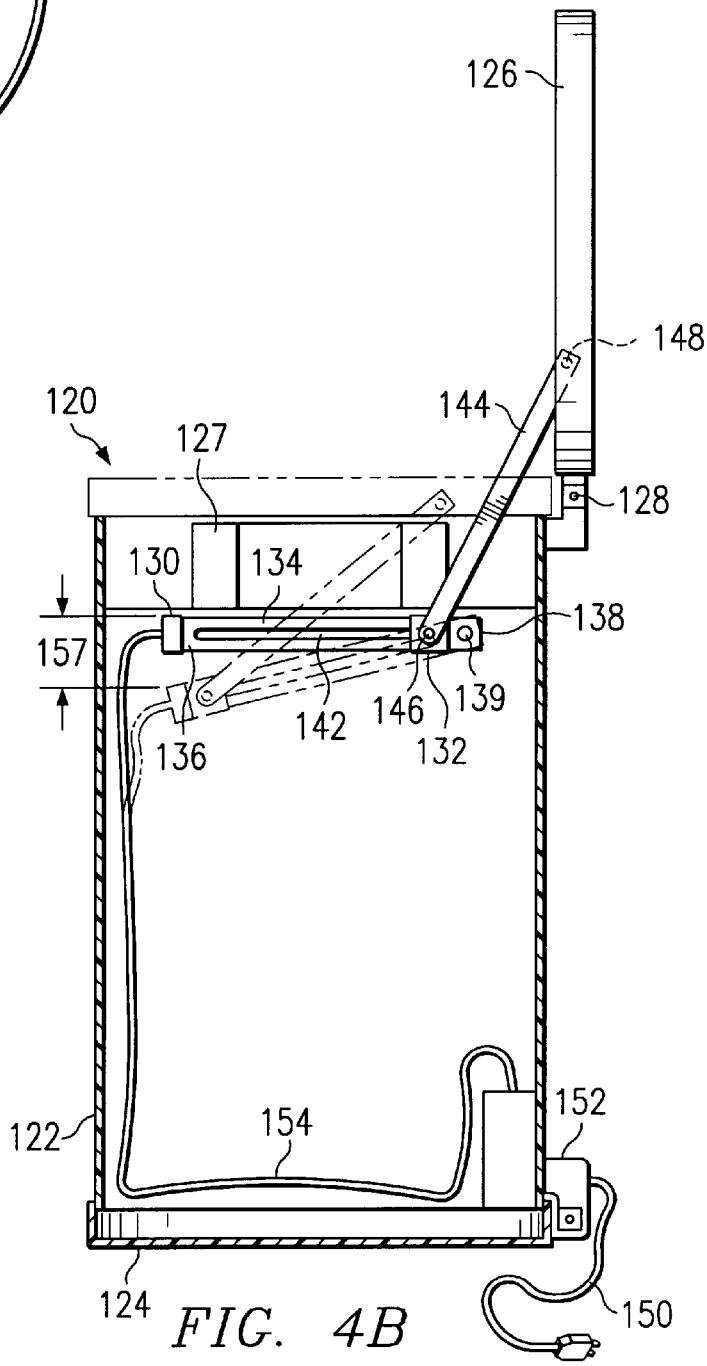

Referring now to FIGS. 4A and 4B, another system 120 for sealably disposing of an object is presented. System 120 is analogous in most respects with that presented in FIGS. 2 and 3, but includes a different approach to sealing. System 120 has a container body 122 with a hinged base 124 and a hinged lid 126. System 120 may have an inner lid such as the inner lid 56 of FIG. 2A. Hinged lid 126 has hinged connection 128 that allows the lid 126 to pivot between an open position shown in FIG. 4B and a closed position shown in hidden lines in FIG. 4B. Because the main differences in this embodiment all center around the sealing means, many of the items shown in FIG. 2 are not presented here such as the flexible tubing 62 and the clasps or springs 68 and the like.

Focusing in on the sealing means, there is a first sealing member 130 and a second sealing member 132. Sealing members 130, 132 are coupled to a hinged track 134. Hinged track 134 has a first end 136 and second end 138. The second end 138 is rotatably connected to body 122 by hinged connection 139. The first sealing member 130 is preferably rigidly coupled to the first end 136 of hinged track 134 but may also be sliceable engaged with it. In any event, the first sealing member 130 is associated with the first end 136 of track 134. Hinged track 134 has a hinged connection 139 on second end 138. The second sealing member 132 is slideably coupled to hinge track 134 and engages a longitudinal slot 142 formed within track 134. An arm 144 is rotatably connected to the second sealing member 132 at one end by slideable connection 146 and rotatably connected by connection 148 to a portion of the hinged lid 126. Arm 144 and connections 146, 148 are arranged such that when the hinged lid 126 is in the open position the sealing members 130, 132 are apart and ready to receive objects and when the hinged lid 126 is placed in the closed position, the second sealing member 132 is forced into contact with the first sealing member 130.

As shown in FIG. 4B, when the hinged lid 126 is in the open position, the sealing member 132 is proximate the second end 138 of hinge track 134 and hinge track 134 is substantially horizontal. When hinge lid 126 is in the closed or sealed position, the second sealing member 132 is caused to contact the first sealing member 130 and the hinged track 134 pivots about its hinged connection and is slightly angled with respect to horizontal. As lid 126 is moved between the open and closed positions, the first end 136 of track 134 angles downward as previously noted. The movement of the first end 136 remains within a horizontal plane having a thickness indicated by dimension 157 and which is preferably less than one-half of the lengthwise (longitudinal) dimension of the package being formed, H (see FIG. 1), and more preferably still ¼ H or less. Thus, instead of relying upon a twisting action of the inner lid as in the embodiment of FIGS. 2 and 3, system 120 relies upon the opening and closing of lid 126 to cause the sealing and optionally cutting to occur.

As noted in connection with the earlier embodiment, the sealing is preferably accomplished through thermal means or by ultrasound or other such techniques. Energy is provided to system 120 through an electrical cord 150 going to a transformer 152; alternatively, batteries or another electrical power source may be used. The power for heating elements on sealing member 130 (and/or 139) is delivered in the shown embodiment through electrical cord 154 although the sealing elements requiring electrical energy can also be located on the second sealing member 132. As presented in the next embodiment, the tracks may also be rigidly attached to the container.

Figure 5A:
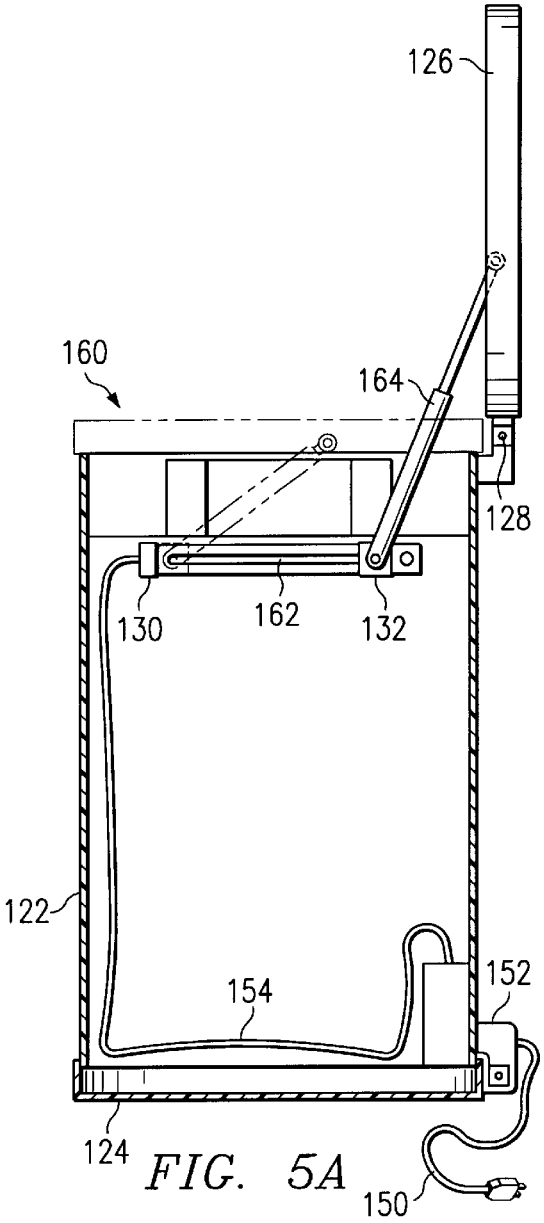
FIG. 5A is another schematic in elevation and cross section of an embodiment of a sealable waste disposal system according to an embodiment of the present that use flexible tubing.

Referring to FIG. 5A, a system 160 for sealably disposing of an object is presented. System 160 is analogous in all respects with the system 120 of FIG. 4 except for the track and arm are different. In system 160, track 162 remains stationary as the hinged lid 126 rotates between an open and closed position. To accommodate the closing of lid 126, arm 164 telescopes (preferably using a piston arrangement) in the open position and compresses in the closed position. Thus, when in the open position, the first sealing member 130 and the second sealing member 132 are apart and when in the closed or sealing position, sealing members 130, 132 are caused to come into contact with each other so that the sealing and optionally cutting may occur as will be described further below, but the track remains level. While the preferred embodiment of FIG. 5A uses flexible tubing as previously described, an individual plastic bag might be used with system 160, e.g., a bag not unlike a plastic grocery bag might be used and then sealed. This alternative embodiment is shown in FIG. 5B.

Figure 5B:
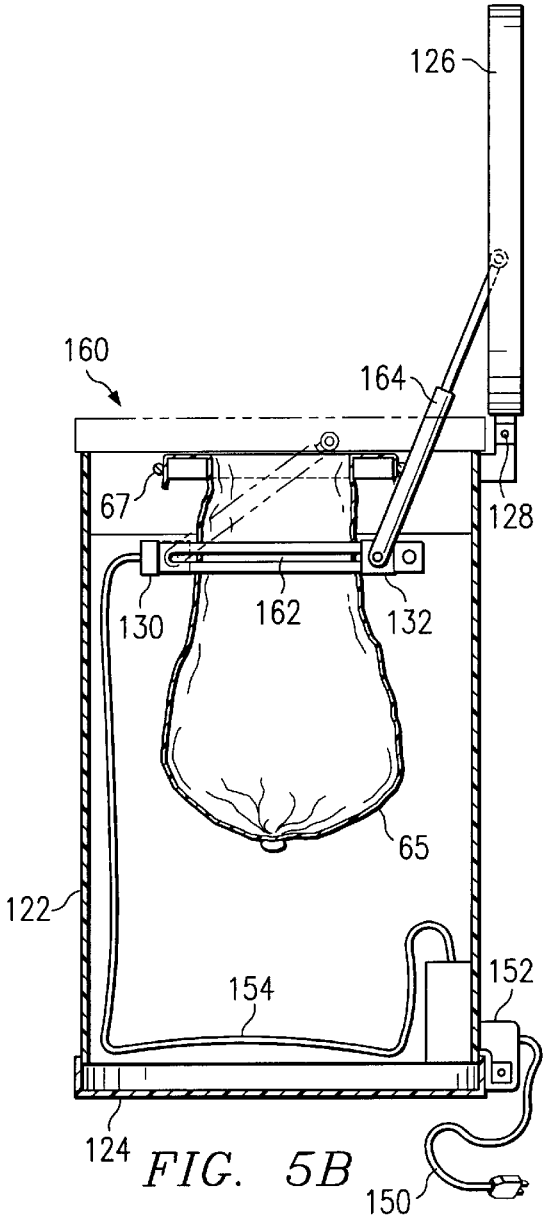
FIG. 5B is a schematic in elevation and cross section of an embodiment of a sealable waste disposal system according to an embodiment of the present that uses individual bags 65.

Referring to FIG. 5B, the individual bag 65 is held in place by annular retainer ring 67. The bag functions similar to the flexible tubing, but bags are loaded one at a time, and each bag is held by the ring 67.

Figure 6:
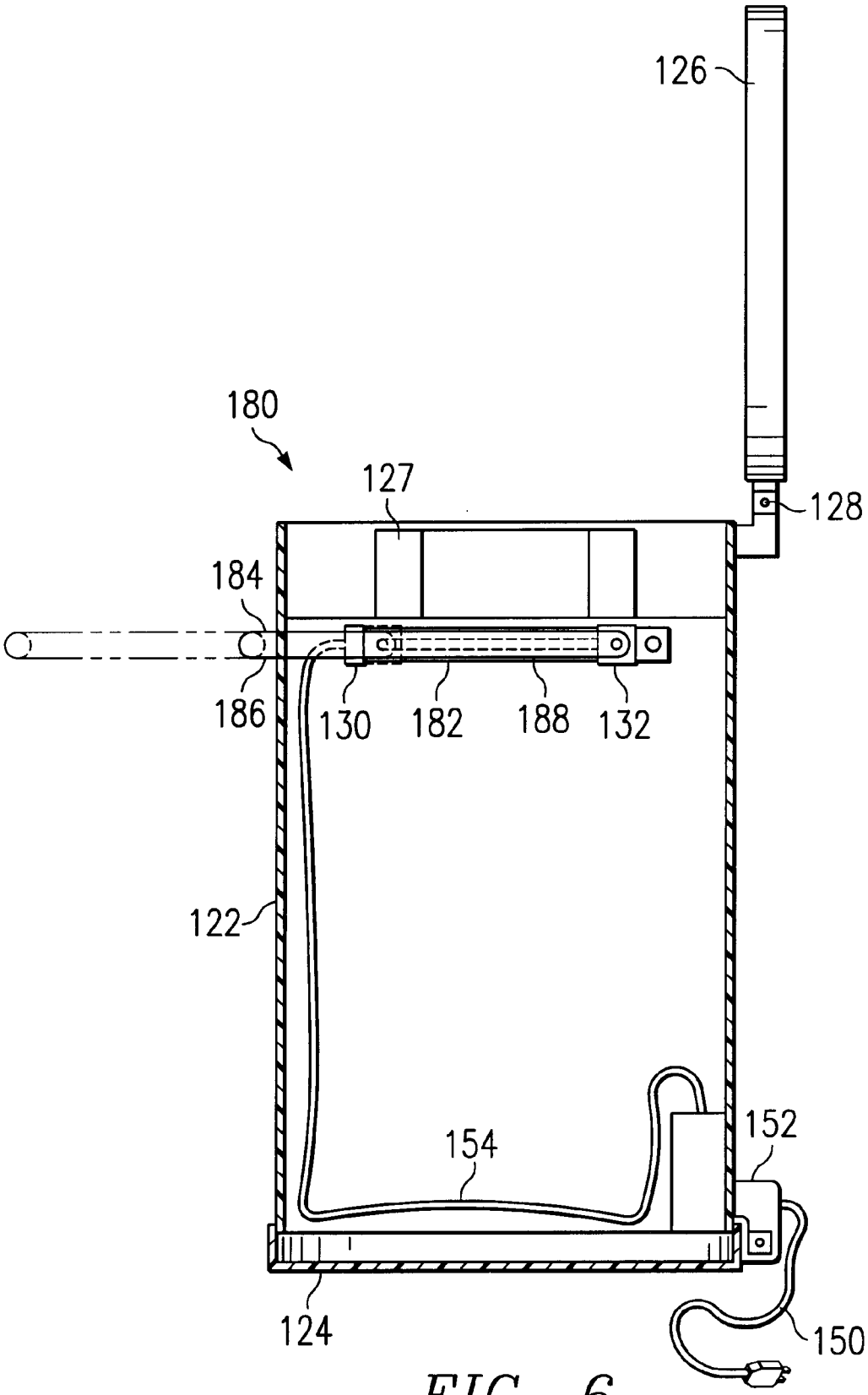
FIG. 6 is a schematic diagram in elevation and cross section of another embodiment of a sealable waste disposal system.

Referring to FIG. 6, another embodiment of a system 180 for sealably disposing of an object is presented. System 180 is analogous in most all respects with that of FIGS. 4 and 5A except for the track and activation technique of bringing the first sealing member 130 into contact with the second sealing member 132. In this embodiment, the track 182 is preferably stationary and is rigidly coupled to the container body 122. An activation arm 184 extends outside of the container body 122 and is movable between an open position and a sealing position; in FIG. 6, the sealing position is shown in hidden lines and the open position is shown in solid lines. Rubber seals are placed around the orifice through which the activation arm 184 extends into and out of body 122. The seals help provide a seal that does not allow odors (if any) to escape from inside of the container 122.

Activation arm 184 has a first end 186 that extends outside of container 122 and a second end 188 that is coupled to the second sealing member 132. Thus, in this embodiment, when the activation arm is moved towards the interior of the container body 122, the sealing members 130, 132 are displaced from each other, i.e., defines an open position. When the activation arm is moved away from the interior of container 122, the sealing members 130, 132 are moved towards each other and eventually into contact with each other. When they are in contact, the sealing and optional cutting of the flexible tubing may take place as will be described further below.

Figure 7:
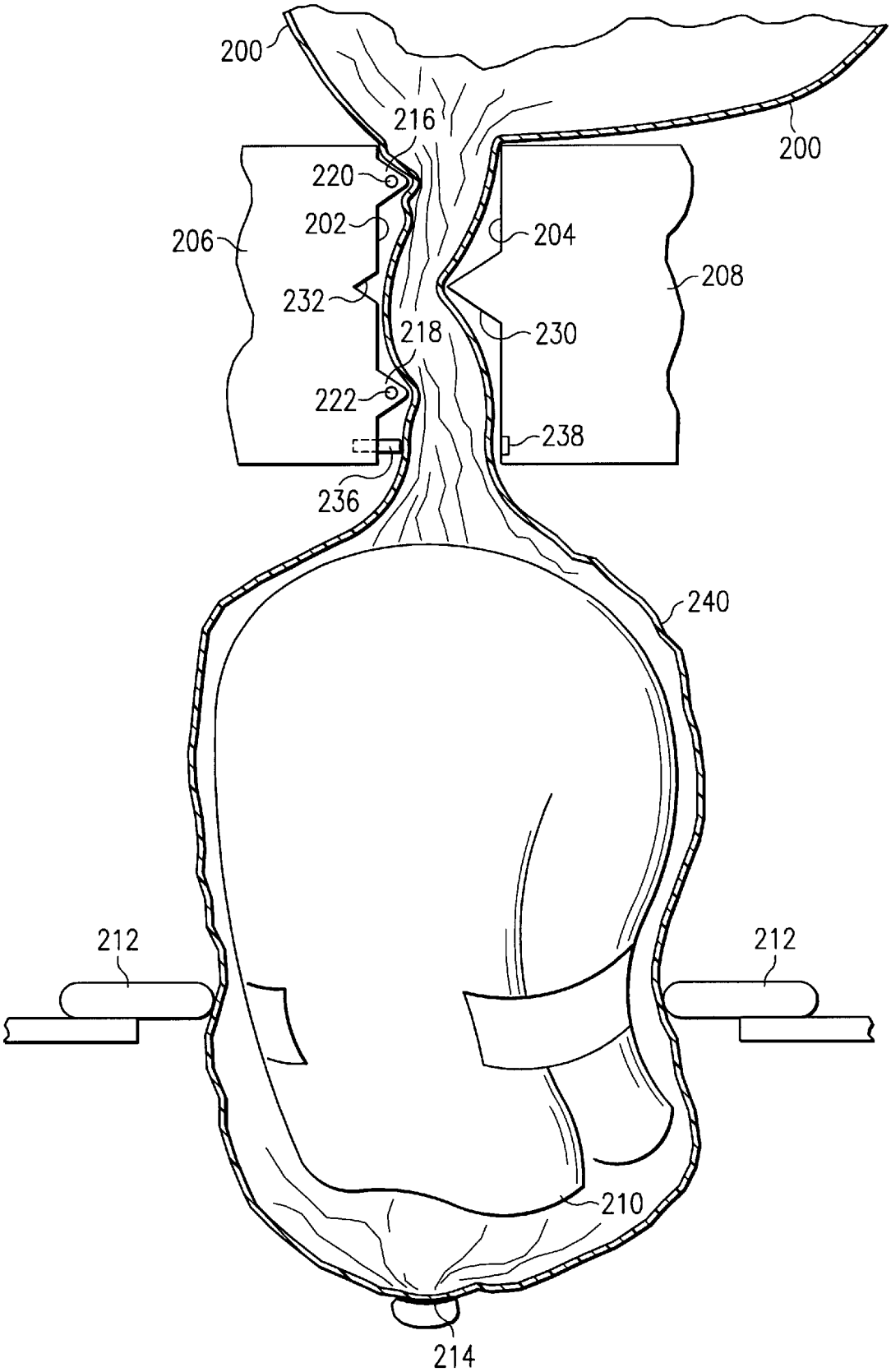
FIG. 7 is a schematic diagram in elevation and cross section of a portion of a sealable waste disposal system showing the sealing members sealing the flexible tubing.

Referring now to FIG. 7, a schematic of the sealing of the flexible material to form one end of a package is described. The flexible material 200 passes through the lateral edges 202, 204 of sealing members 206, 208, respectively. The flexible material 200 extends below the sealing members 206, 208 and around an object 210 that is to be sealed. The flexible material 200 has a bottom portion formed with seal 214 from a previous sealing and cutting operation. The object is held in position during sealing by springs or clips 212 that impinge on a lower portion of object 210 to hold it in place and to prevent the object from placing too much tension on the flexible material 200. While the object is held in place, the sealing members 206, 208 are moved towards each other to bring them into substantial contact with the flexible material 200 between them. The moving of members 206, 208 may be accomplished by numerous techniques as described in connection with previous figures.

The first sealing member 206 has a first sealing element 216 and a second sealing element 218. In the preferred embodiment as shown in FIG. 7, the sealing elements are thermal and contain heating elements 220, 222 which during the sealing operation are caused to become sufficiently hot to melt and fuse the flexible material 200 between each sealing element 216, 218, and the corresponding portion of the lateral edge 204 of second sealing member 208. If cutting between packages is desired, a cutting member or edge 230 is formed on lateral edge 204 of second sealing member 208. A receiving cavity 232 is formed on the first sealing member 206 such that the cutting member 230 engages cavity 232 and cuts the flexible material 200 therebetween. A heating element could also be used as the cutting element to cut the material; that is, a middle heating element could provide enough energy to sever the flexible material at that location.

An activation pin 236 is placed on sealing member 206 and a receiving cavity 238 is formed within sealing member 208. The activation pin 236 and receiving cavity 238 allow a circuit to control the sealing operation and cutting if applicable. The activation pin 236 is used to trigger circuitry.

A sealing operation occurs as follows. As the first sealing member 206 and a second sealing member 208 come into close proximity, the pin 236 pushes into cavity 238 along with a small portion of the flexible material 200. As the pin 236 reaches a sufficient distance within cavity 238 electronic circuitry is triggered causing electrical energy to go through heating elements 220, 222 for a specified period of time determined by the thickness and type of material for flexible material 200. The circuitry can take any of numerous forms. For example, when pin 236 makes momentary contact, it can close a normally open relay. This in turn energizes the heating elements and starts a timing circuit. After a set period of time (e.g., one to five seconds or more), the heating elements are de-energized and the circuitry returns to its initial state awaiting subsequent activity. The time required corresponds to the amount of energy necessary to fuse together the two portions of the flexible material 200 to form two full seals, one located proximate the heating element 220 and the other proximate the heating element 222. Meanwhile, the cutting member 230 engages cavity 232 and completely severs the flexible material 200 at that point. Thus, with the cutter in place, as the sealing members 206, 208 are pulled away from each other, the completed package 240 is free to fall into a storage area. In this embodiment, the various elements such as the sealing elements 216, 218 and the cutting member 230 can be located on either the first sealing member 206 or the second sealing member 208.

Although the present invention and its advantages have been described in detail, it should be understood that various changes, substitutions and alterations can be made therein without departing from the spirit and scope of invention as defined by the appended claims. For example, components shown in one figure can be combined with those shown in other figures.

What is claimed is:

1. In a waste disposal system for placing objects in packages, with each package having an average lengthwise dimension H and each formed from flexible tubing, and the system having a container body, base, a hinged lid, an inner lid, and a tubular core that holds flexible tubing, the improvement comprising:

a first stationary track rigidly coupled to the container body;

a second stationary track rigidly coupled to the container body substantially parallel and displaced from the first track;

a first sealing member having a first end and a second end and having a longitudinal slot, the first sealing member slideably coupled to the first and second tract, the first sealing member having a first and second lateral edge;

a second sealing member having a first end and a second end and having a longitudinal slot, the second sealing member slideably coupled to the first and second stationary tracks, the second sealing member having a first and second lateral edge and wherein the second lateral edge of the first sealing member is formed and configured to mate substantially with the first lateral edge of the second sealing member;

wherein the tubular core has a bottom portion and the bottom portion has a first and second pin rigidly coupled thereto, and wherein the first pin extends through the longitudinal slot of the first sealing member and the second pin extends through the longitudinal slot of the second sealing member;

a first sealing element coupled to the second lateral edge of the first sealing member or the first lateral edge of the second sealing member:

a second sealing element coupled to the second lateral edge of the first sealing member or the first lateral edge of the second sealing member that is displaced from the first sealing element and that is selectably operable to seal the flexible tubing between the first and second sealing members.

2. The system of claim 1 further comprising: a cutting element coupled to the second lateral edge of the first sealing member or the first lateral edge of the second sealing member between the first and second sealing elements, the cutting element operable to cut the flexible tubing when the sealing members are placed in a sealing position.

3. In a waste disposal system for placing objects in packages, which are formed from flexible material, and the system having a container body, base, a hinged lid, an inner lid, and a tubular core holding flexible material, the improvement comprising:

a first hinged track having a first end and a second end, the first hinged track pivotably coupled to the container body at the second end of the first hinged track;

a second hinged track having a first and a second end, the second hinged track pivotably coupled to the container body at the second end of the second hinged track;

a first sealing member associated with first end of the first hinged track and the first end of the second hinged track;

a second sealing member slideably coupled to the first and second hinged tracks;

a first sealing element coupled to the first or second sealing member;

a second sealing element coupled to the first or second sealing member;

an attachment arm rotatably coupled to the second sealing member and to the hinged lid and sized and configured so that when the lid is an open position for receiving an object the first and second sealing elements are apart and when the lid is in a closed position the first and second sealing elements substantially mate in a sealing position; and wherein the first and second sealing members are sized and configured to substantially engage one another when in the sealing position and thereby to bring the first and second sealing elements into contact with the flexible material to allow formation of a first seal and a second seal.

4. The system of claim 3 further comprising a cutting element coupled to the first or second sealing member and wherein the first and second sealing members are sized and configured to substantially engage one another when in the sealing position and thereby to bring the first and second sealing elements into contact with the flexible material to allow formation of a first seal and a second seal and to cause the cutting element to cut between the first and second seals.

5. In a waste disposal system for placing objects, such as diapers, in packages, which are formed from flexible tubing and the system having a container body, base, a hinged lid, an inner lid, a tubular core holding flexible tubing, the improvement comprising:

a first track having a first end and a second end, the first track coupled to the container body;

a second track having a first and a second end, the second track coupled to the container body;

a first sealing member associated with the first ends of the first and second tracks;

a second sealing member slideably coupled to the first and second tracks;

a first sealing element coupled to the first sealing member or the second sealing member;

a second sealing element coupled to the first sealing member or the second sealing member;

a telescoping attachment arm having a first and second end, the attachment arm rotatably coupled to the second sealing member and to the hinged lid and sized and configured so that when the lid is an open position the first and second sealing elements are apart in an open position and when the lid is closed the first and second sealing elements are brought into substantial contact in a sealing position; and wherein the first and second sealing members are sized and configured to substantially mate with each other to bring the first and second sealing elements into contact with the flexible tubing when in the sealing position to form a first seal and a second seal.

6. The system of claim 5 further comprising a cutting element coupled to the first sealing member or the second sealing member between the first sealing element and the second sealing element; and wherein the first and second sealing members are sized and configured to substantially mate with each other to bring the first and second sealing elements into contact with the flexible tubing when in the sealing position to form a first seal and a second seal and to cause the cutting element to cut between the first and second seals.

7. In a waste disposal system for placing objects in packages, which are formed from flexible tubing, having a container body, base, a hinged lid, an inner lid, a tubular core holding flexible tubing, the improvement comprising:

a first track having a first end and a second end, the first track coupled to the container body;

a second track having a first and a second end, the second track coupled to the container body;

a first sealing member associated with the first ends of the first and second tracks;

a second sealing member slideably coupled to the first and second tracks;

a first sealing element coupled to the first sealing member or second sealing member;

a second sealing element coupled to the first sealing member or second sealing member;

a activation arm having a first and second end, the first end extending outside the container and the second end of the activation arm rotatably coupled to the second sealing member, the activation arm sized and configured so that when the activation arm is an open position, the first and second sealing elements are apart in an open position and when the activation arm is in a closed position, the first and second sealing elements are brought into contact with the first or second sealing member in a sealing position; and wherein the first and second sealing members are sized and configured to substantially mate with each other to bring the first and second sealing elements into substantial contact with the flexible tubing when in the sealing position to allow formation of a first seal and a second.

8. The system of claim 7 further comprising a cutting element coupled to the first sealing member or second sealing member; and wherein the first and second sealing members are sized and configured to substantially mate with each other to bring the first and second sealing elements into substantial contact with the flexible tubing when in the sealing position to allow formation of a first seal and a second seal and to cause the cutting element to cut between the first and second sealing members.

9. In a waste disposal system for placing objects in packages, which each have an average longitudinal dimension H and formed from flexible material, having a container body, base, a hinged lid, an inner lid, and a tubular core holding flexible material, the improvement comprising:

a means for sealing a portion of the flexible material together in a substantially an air-tight manner and cutting the flexible material to allow for discrete sealed packages to be formed with the objects therein, and wherein the means for sealing includes a first and second sealing members that are together operable to travel between an open position to a closed, sealing position while the first and second sealing members remain within a horizontal plane having a longitudinal dimension no greater than ⅓ H; and wherein the means for sealing further comprises: a means for suspending the first and second sealing members within the container body, the means for suspending is operable to allow relative movement of the first and second sealing members between the open position and closed (sealing) position.

* * * * *